US007680424B2

(12) United States Patent
Hurst et al.

(10) Patent No.: US 7,680,424 B2
(45) Date of Patent: Mar. 16, 2010

(54) ROLLER FUSER SYSTEM WITH FUSING MEMBER TEMPERATURE CONTROL FOR PRINTING

(75) Inventors: James H. Hurst, Rochester, NY (US); John L. Hryhorenko, Webster, NY (US); Muhammed Aslam, Rochester, NY (US); Douglas J. Kostyk, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 207 days.

(21) Appl. No.: 11/863,519

(22) Filed: Sep. 28, 2007

(65) Prior Publication Data

US 2009/0087202 A1 Apr. 2, 2009

(51) Int. Cl.
*G03G 15/00* (2006.01)

(52) U.S. Cl. ..... 399/45

(58) Field of Classification Search ..... 399/45, 399/67, 69, 70, 320, 328, 330; 219/216
See application file for complete search history.

(56) References Cited

U.S. PATENT DOCUMENTS 3,983,287 A 9/1976 Goossen et al.
4,791,275 A 12/1988 Lee et al.
4,984,027 A 1/1991 Derimiggio et al.
5,450,153 A 9/1995 Matsumoto
5,956,543 A 9/1999 Aslam et al.
6,016,409 A 1/2000 Beard et al.
6,224,978 B1 5/2001 Chen et al.
6,611,670 B2 * 8/2003 Chen et al. ..... 399/328
6,799,000 B2 * 9/2004 Aslam et al. ..... 399/45
7,058,329 B2 * 6/2006 Takahashi ..... 399/69

OTHER PUBLICATIONS

J. H. DuBois and F. W. John, Eds., in Plastics, 5th Edition, Van Nostrand and Rheinhold, 1974.

* cited by examiner

*Primary Examiner*—Hoan H Tran
(74) *Attorney, Agent, or Firm*—Donna P. Suchy

(57) ABSTRACT

Internally-heated external rollers transfer heat rapidly to a fuser roller in an electrostatographic printer. Stored media process set points, input image content and input media type data are used to regulate the heat transfer rate by varying the nip width between the heated external rollers and the fuser roller. The rate of heat transfer and the rate of heat transfer adjustment are sufficiently rapid that many different media weights and types may be mixed in a print run without restrictions on media run lengths, without collation requirements per run, and without productivity losses due to slowing of feed rate for heavier receivers.

19 Claims, 7 Drawing Sheets

ROLLER FUSER SYSTEM WITH FUSING MEMBER TEMPERATURE CONTROL FOR PRINTING

FIELD OF THE INVENTION

This invention relates in general to electrographic printing, and more particularly to the control of temperature of roller fusing members.

BACKGROUND OF THE INVENTION

In electrostatographic imaging and recording processes such as electrophotographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper or plastic, and the toner image is subsequently fused to the receiver in a fusing station using heat or pressure, or both heat and pressure. The fuser station can include a roller, belt, or any surface having a suitable shape for fixing thermoplastic toner powder to the receiver.

The fusing step in a roller fuser commonly consists of passing the toned receiver between a pair of engaged rollers that produce an area of pressure contact known as a fusing nip. In order to form the fusing nip, at least one of the rollers typically has a compliant or conformable layer on its surface. Heat is transferred from at least one of the rollers to the toner in the fusing nip, causing the toner to partially melt and attach to the receiver. In the case where the fuser member is a heated roller, a resilient compliant layer having a smooth surface is typically used which is bonded either directly or indirectly to the core of the roller. Where the fuser member is in the form of a belt, e.g., a flexible endless belt that passes around the heated roller, it typically has a smooth, hardened outer surface.

Most roller fusers, known as simplex fusers, attach toner to only one side of the receiver at a time. In this type of fuser, the roller that contacts the unfused toner is commonly known as the fuser roller and is usually the heated roller. The roller that contacts the other side of the receiver is known as the pressure roller and is usually unheated. Either or both rollers can have a compliant layer on or near the surface. In most fusing stations having a fuser roller and an engaged pressure roller, it is common for only one of the two rollers to be driven rotatably by an external source. The other roller is then driven rotatably by frictional contact.

In a duplex fusing station, which is less common, two toner images are simultaneously attached, one to each side of a receiver passing through a fusing nip. In such a duplex fusing station there is no real distinction between fuser roller and pressure roller, both rollers performing similar functions, i.e., providing heat and pressure.

Two basic types of simplex heated roller fusers have evolved. One uses a conformable or compliant pressure roller to form the fusing nip against a hard fuser roller, such as in a DocuTech 135 machine made by the Xerox Corporation. The other uses a compliant fuser roller to form the nip against a hard or relatively non-conformable pressure roller, such as in a Digimaster 9110 machine made by the Eastman Kodak Company. A fuser roller designated herein as compliant typically includes a conformable layer having a thickness greater than about 2 mm and in some cases exceeding 25 mm. A fuser roller designated herein as hard includes a rigid cylinder, which may have a relatively thin polymeric or conformable elastomeric coating, typically less than about 1.25 mm thick.

A compliant fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

A conventional toner fuser roller includes a cylindrical core member, often metallic such as aluminum, coated with one or more synthetic layers, which typically include polymeric materials made from elastomers.

One common type of fuser roller is internally heated, i.e., a source of heat for fusing is provided within the roller for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity. A different kind of fuser roller, which is internally heated near its surface, is disclosed by Lee et al. in U.S. Pat. No. 4,791,275, which describes a fuser roller including two polyimide Kapton RTM sheets (sold by DuPont.RTM. and Nemours) having a flexible ohmic heating element disposed between the sheets. The polyimide sheets surround a conformable polyimide foam layer attached to a core member. According to J. H. DuBois and F. W. John, Eds., in Plastics, 5th Edition, Van Nostrand and Rheinhold, 1974, polyimide at room temperature is fairly stiff with a Young's modulus of about 3.5 GPa-5.5 GPa (1 GPa=1 GigaPascal=10.sup.9 Newton/m.sup.2), but the Young's modulus of the polyimide sheets can be expected to be considerably lower at the stated high operational fusing temperature of the roller of at least 450 degrees F.

An externally heated fuser roller is used, for example, in an Image Source 120 copier, and is heated by surface contact between the fuser roller and one or more external heating rollers. Externally heated fuser rollers are also disclosed by O'Leary, U.S. Pat. No. 5,450,183, and by Derimiggio et al., U.S. Pat. No. 4,984,027.

A compliant fuser roller may include a conformable layer of any useful material, such as for example a substantially incompressible elastomer, i.e., having a Poisson's ratio approaching 0.5. A substantially incompressible conformable layer including a poly(dimethyl siloxane) elastomer has been disclosed by Chen et al., in the commonly assigned U.S. Pat. No. 6,224,978, which is hereby incorporated by reference. Alternatively, the conformable layer may include a relatively compressible foam having a value of Poisson's ratio much lower than 0.5. A conformable polyimide foam layer is disclosed by Lee in U.S. Pat. No. 4,791,275 and a lithographic printing blanket are disclosed by Goosen et al. in U.S. Pat. No. 3,983,287, including a conformable layer containing a vast number of frangible rigid-walled tiny bubbles, which are mechanically ruptured to produce a closed cell foam having a smooth surface.

Receivers remove the majority of heat during fusing. Since receivers may have a narrower length measured parallel to the fuser roller axis than the fuser roller length, heat may be removed differentially, causing areas of higher temperature or lower temperature along the fuser roller surface parallel to the roller axis. Higher or lower temperatures can cause excessive toner offset (i.e., toner powder transfer to the fuser roller) in roller fusers. However, if differential heat can be transferred axially along the fuser roller by layers within the fuser roller having high thermal conductivity, the effect of differential heating can be reduced.

Improved heat transfer from the core to the surface of an internally heated roller fuser will reduce the temperature of the core as well as that of mounting hardware and bearings that are attached to the core. Similarly, improved heat transfer to the surface of an externally heated fuser roller from external heat transfer rollers will reduce the temperature of the external heat transfer rollers as well as the mounting hardware and bearings attached to the external heating rollers.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient conformable layer. The extent of the contact area helps establish the length of time that any given portion of the toner image will be in contact with, and heated by, the fuser roller.

A fuser module is disclosed by M. E. Beard et al., in U.S. Pat. No. 6,016,409, which includes an electronically-readable memory permanently associated with the module, whereby the control system of the printing apparatus reads out codes from the electronically readable memory at install to obtain parameters for operating the module, such as maximum web use, voltage and temperature requirements, and thermistor calibration parameters.

In a roller fusing system, the fusing parameters, namely the temperature, nip-width, and speed of the fusing member, are fixed and controlled within certain specifications for a given range of receivers. Generally the system changes the temperature or/and speed according to the receiver weights or types. The changing of temperature in an internally heated fuser roller takes time to stabilize. If the receivers are presented at a too-rapid rate, the fuser roller may not have returned to its working temperature when the next receiver arrives. Consequently, the receivers must be stopped or slowed until the temperature of the fuser roller has come within acceptable range and such stopping or slowing results in degradation of receiver throughput rate. The same is true for speed changes. Regardless of whether the speed of presentation or the fuser roller temperature itself is being adjusted by the system, the temperature stabilization time required by a fusing member can constrain the speed of presentation of receivers.

The fixing quality of toned images of an electrophotographic printer depends on the temperature, nip-width, process speed, and thermal properties of the fusing member, toner chemistry, toner coverage, and receiver type. To simplify the engineering and control of a roller fusing system, as many as possible of the above parameters are considered and then fixed during the system's design. The fusing parameters such as temperature, nip-width, process speed, and thermal properties of the fusing member are optimized for the most critical case.

Complicating the system's design is the fact that the toner coverage and the receiver type (weight, coated/uncoated) can vary from image to image in a digital printer. Therefore, some of the above listed parameters need to be adjusted according to the image contents and the receiver types to assure adequate image fixing. Typically, the fuser temperature is adjusted and kept constant for a dedicated run with a particular receiver. The temperature is adjusted higher from the nominal for heavier receivers and lower for lighter receivers. For some heavy receivers, the speed must also be reduced.

The change of fusing speed results in reduced productivity. The change in fusing temperature can also result in reduced productivity because of time spent waiting for the fusing member temperature to change. Furthermore, if different receiver types are required in a single document, extra time is needed to collate images on different receivers into the document.

A digital printer with multiple paper supplies allows running RIPPED information that varies from image to image onto multiple receivers in a single document run. Since the RIPPED image may vary from one occurrence to the next, both in image color and image density, the workload on the fuser may vary significantly. U.S. Pat. No. 5,956,543, issued to Aslam et al. optimizes the image fixing of toned images on a specified receiver by optimally selecting the fuser temperature, nip-width and speed. However, it does not address the image fixing quality issues when multiple types and weights of receivers are mixed during a document mode operation of an electrophotographic printer.

SUMMARY OF THE INVENTION

The invention uses internally heated external rollers to transfer heat rapidly to and from a fuser roller in an electrophotographic printer. The invention uses stored media process set points, input image content, and input media type data to regulate the heat transfer rate by varying the nip width between the heated external rollers and the fuser roller. The rate of heat transfer and the rate of heat transfer adjustment are sufficiently rapid that the invention allows mixing of many different media weights and types in a print run without restrictions on media run lengths, without collation requirements per run, and without productivity losses due to slowing of feed rate for heavier receivers.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
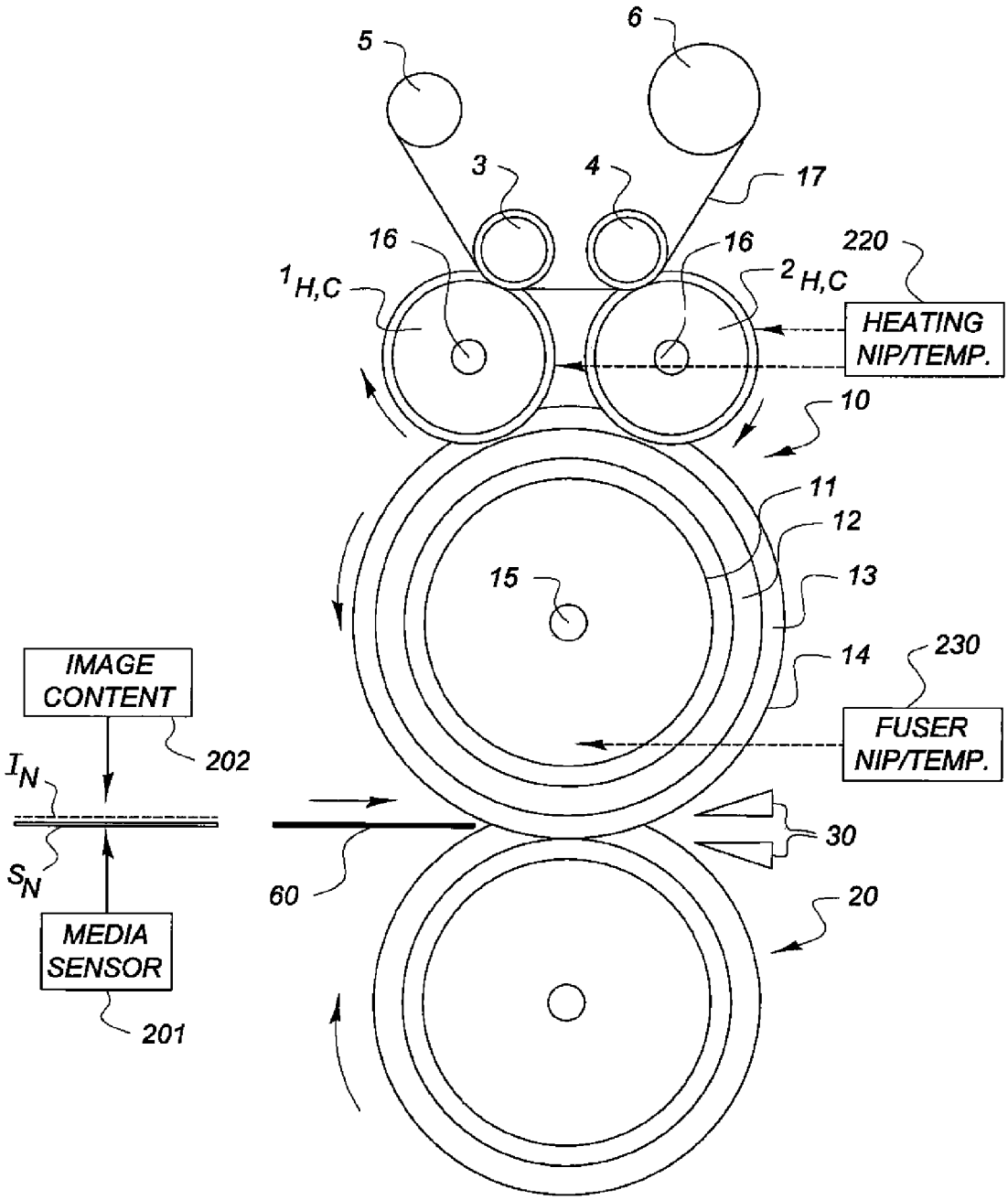
FIG. 1 shows a schematic of the fuser assembly according to this invention.

A schematic sketch of the fuser assembly disclosed in this invention is shown in FIG. 1. The fuser assembly includes a fusing member roller 10 and a pressure roller 20. Fusing member roller 10 is heated with an internal heat source 15 (lamp) and external heat transfer rollers 1 and 2 separately controlled can heat or cool the fuser roller, thus efficiently and quickly adjusting the fuser roller's temperature as needed. The external heat transfer rollers 1 and 2 can be either heated or cooled, such as with rollers acting as heat sinks, as will be discussed in more detail below. The number and sizes of external heat transfer rollers and the sizes of the fusing member rollers 10 and 20 depend on the printer process speed and the heat requirements for proper image fixing. Any toner or paper dust contamination on the heating members 1 and 2 is cleaned with a cleaning web 17 trained around take-up and supply rollers 5 and 6 respectively and corresponding back up rollers 3 and 4. In alternative embodiments, the cleaning is accomplished by other mechanisms well-known in the art, such as blade cleaning or tacky rollers for example.

The receiver (sheet) release from the fusing member rollers 10 and 20, is accomplished by a pair of air knives 30, including an air skive that can force cooling air towards the nip. In alternative embodiments of the invention, mechanical pawls or skive fingers for example, are utilized for receiver stripping, replacing the air knives. Further, toner offset prevention is accomplished by application of a release fluid to the fusing member rollers. The release fluid applicator is not shown in the diagram, but either a donor roller type or a web type applicator may be employed.

The fusing member roller 10 includes an aluminum core 11, an elastomeric base-cushion 12 (relatively more compliant than the pressure roller), a conductive elastomeric intermediate layer 13 (5 to 10 mils thick depending on the process speed), and finally a thin (1-2 mil) top release coating 14. The external heat transfer rollers 1, 2, in one embodiment, are conductive metallic (steel, aluminum, etc.) cores with finished metalized hard surface such as chrome, nickel, anodized aluminum, etc. Other embodiments of the external heat transfer rollers use conductive Teflon.RTM. based coatings on the respective conductive cores or high density heat transfer rollers that absorb heat using heat transfer materials.

The external heat transfer rollers that are used for heating, referred to as heating rollers $\mathbf{1}_H$, $\mathbf{2}_H$ are heated with internal lamps 16 as has been disclosed by Aslam et al., in the commonly assigned U.S. Pat. No. 6,799,000, which is hereby incorporated by reference. An internal heat lamp 15 maintains a predetermined desired temperature of fusing member roller 10 during the standby mode when external heating rollers $\mathbf{1}_H$, $\mathbf{2}_H$ are not engaged. The heat input for fusing of toner comes mainly from external heating rollers $\mathbf{1}_H$, $\mathbf{2}_H$ to the fusing member roller 10 during the print mode. A limited amount of additional heat comes from the fusing member's internal heat source 15 as a thermal ballast during the print mode to keep the core of the fusing member roller 10 within the desired predetermined temperature range.

Similarly the external heat transfer rollers that are used for cooling, referred to as cooling rollers $\mathbf{1}_C$, $\mathbf{2}_C$ are made of a heat transfer material that allows for cooling of the fuser roller are undependably controlled from the heater rollers and can be one or more of the external heat transfer rollers 1,2. The heat transfer roller can actually be independently cooled if needed. A predetermined desired temperature of fusing member roller 10 is maintained by a combination of the independently controlled heated rollers and the heat transfer or cooler rollers during the standby mode when external heating rollers 1, 2 are not engaged. The heat input or output for fusing of toner comes mainly from external heat transfer rollers $\mathbf{1}_{H,C}$, $\mathbf{2}_{H,C}$ to the fusing member roller 10 during the print mode. A limited amount of additional heat comes from the fusing member's internal heat source 15 as a thermal ballast during the print mode to keep the core of the fusing member roller 10 within the desired predetermined temperature range.

Figure 6:
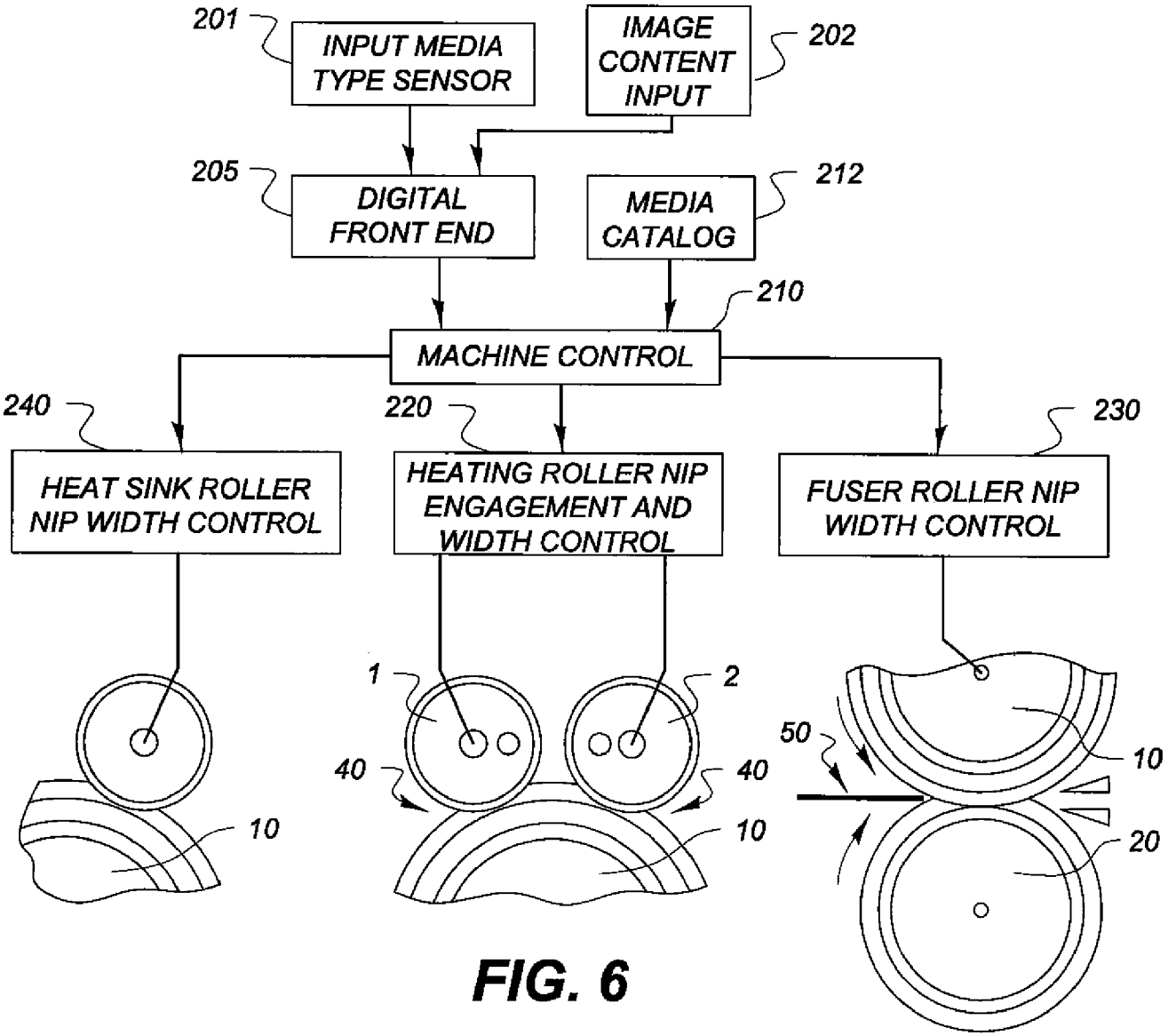
FIG. 6 shows a block diagram of the fuser control mechanism according to this invention.

A sheet $S_N$ bears a toner image $I_N$ and, as indicated in FIG. 6, the toner content of the image and the type of media that receives the image are provided to the digital front end 205 associated with the printer. The digital front end 205 and media catalog 212 provide the printer machine control 210 with signals representing respectively image content, and type of media and parameters of such media type being used. For quality control purposes, the apparatus has a media sensor 201 that senses the type and weight of the sheet $S_n$ and an image content sensor 202 senses the amount of toner that forms the image, $I_N$. The heating roller controller 220, associated with the machine control 210, controls the nip between rollers 1, 2 and 10 as well as the temperature of each heating roller 1, 2. The fuser roller nip width controller 230, associated with the machine control 210, controls the temperature of roller 10 and the nip between rollers 10 and 20. The heat sink roller controller 240, associated with the machine control 210, controls the nip-width between 1*c*, 2*c* rollers and the heated fusing member 10, and the temperature of the heated fusing member 10 to avoid local temperature variation of fusing member 10 due to inter-frame. This embodiment actually has two or more separate machine controllers for two or more rollers so that the external heated rollers can be independently spaced and controlled.

Figure 2:
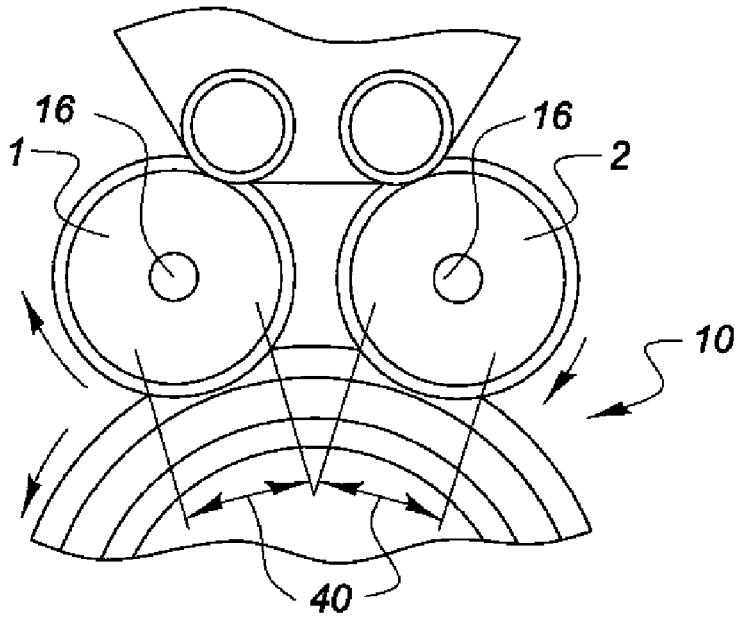
FIG. 2 shows the heat transfer rollers and the fuser roller, and the nips between them, for the fuser assembly of FIG. 1.
Figure 5:
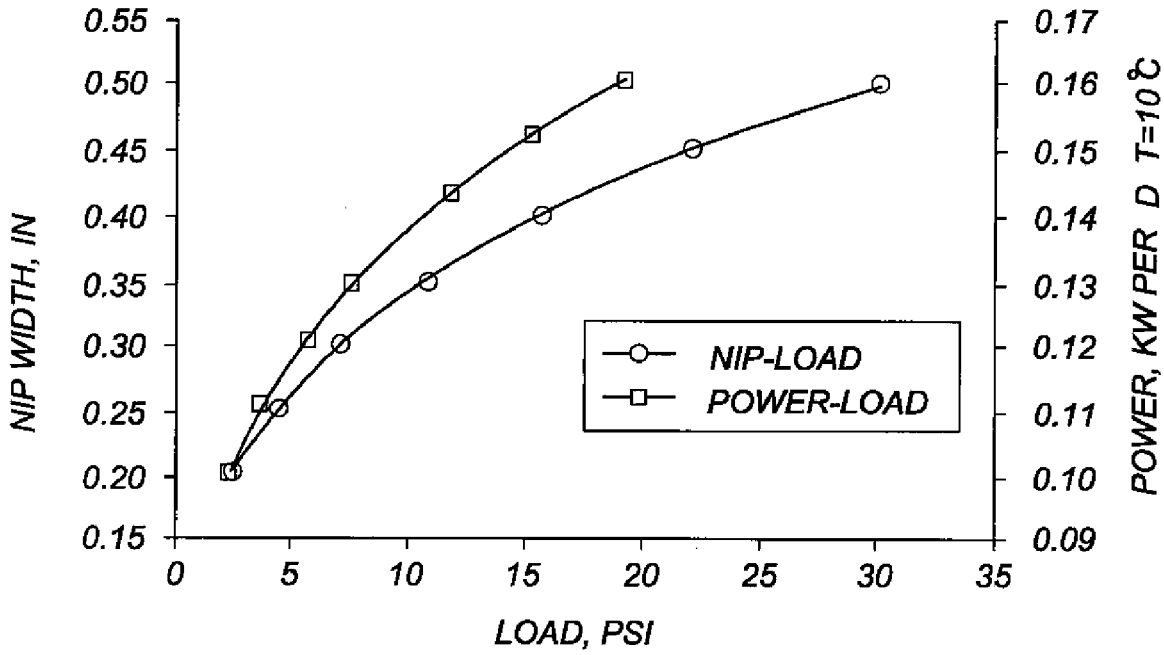
FIG. 5 shows a graph of the relationship between the applied load and nipwidth, according to this invention, giving the power transferred at different levels of load.

The fuser assembly according to this invention adjusts the fuser member roller 10 temperature to various set points by changing the nip width 40 (see FIG. 2) or contact time between the heating rollers 1, 2 and the fuser member roller. The temperature of the heating rollers $\mathbf{1}_H$ and $\mathbf{2}_H$ is maintained constant, but the heat input to the fusing member roller 10 is controlled by the nip width (dwell time) 40 between the heating rollers and the fuser member roller. The graph of FIG. 5 shows an example of the relationship between the applied load and nipwidth and corresponding power that can be transferred to the fuser roller for every 10.degree. C. temperature difference between the heating rollers and the fuser member roller.

The fuser assembly according to this invention also applies print engine intelligence as referred to above. The fuser process set-points (fuser nipwidth, fuser member temperature, and energy requirements) for various types of media are stored as lookup tables in a media catalog 212 for the machine control unit 210 (see FIG. 6). The media can include heavy stock cover material, interior page print material, insert material, transparency material, or any other desired media to carry text or image information. A typical machine control unit 210 includes a microprocessor and memory or microcomputer. It stores and operates a program that controls operation of the machine in accordance with programmed steps and machine inputs, such as temperature of the fusing rollers. Temperature data is supplied, for example, by a thermocouple (not shown) or any other suitable thermal sensor in a manner well known to those skilled in the art. As a sheet of a specific media type is requested, the DFE 205 provides a data signal to the machine control unit 210 (or alternatively, directly to an independent control for the fuser assembly) that is representative of the image contents and the type of media sheet coming to be fixed. The machine control unit 210 sets the fuser conditions (temperature; dwell time) from the media catalog 212 as a function of the data provided by the DFE 205. Machine control unit 210 directs the heating roller nip width control 220 for heating rollers $\mathbf{1}_H$, $\mathbf{2}_H$ to adjust the nipwidth 40 according to the power requirements of the fusing member roller 10 per the information provided from media catalog 212. Machine control unit 210 also directs the fuser roller nip width controller 230 for fusing member 20 to adjust the fuser nip 50 per the information provided from media catalog 212.

Figure 3:
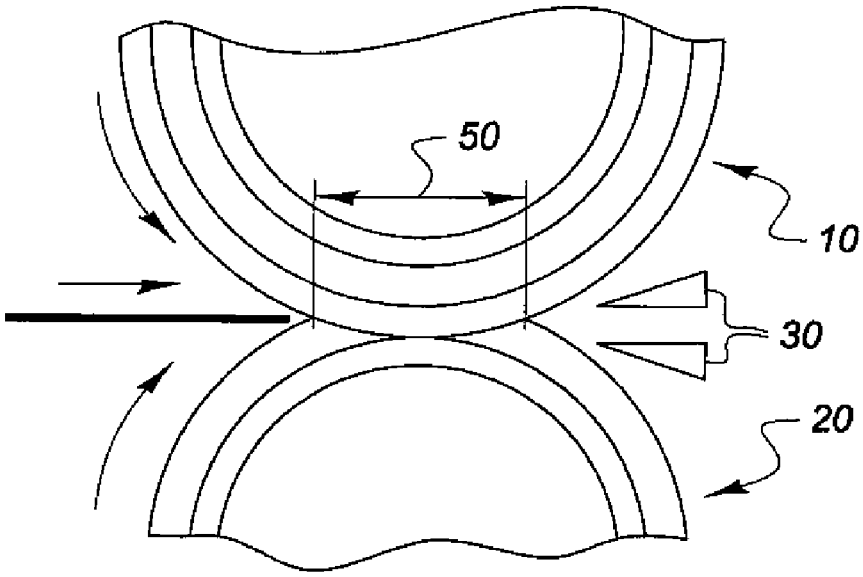
FIG. 3 shows the fuser roller and the pressure roller, and the nip between them, for the fuser assembly of FIG. 1.

The energy in the fuser roller 10 is stored only in its top coating and the conductive intermediate layer (5-10 mils). See FIG. 3 and FIG. 6. Therefore, after the passage of each sheet through the fuser nip 50, the fuser surface temperature drops significantly and heat energy needs to be restored back in the fusing member roller 10 by the heating rollers $\mathbf{1}_H$, $\mathbf{2}_H$ during their contact time. Since the heating rollers 1, 2 are made of thermally conductive materials, the heat transfer rate to the fuser member roller 10 is quite fast. As one media type is followed by a different media type, the machine control unit 210 is informed of the different types and it loads the corresponding fuser setup conditions from the media catalog 212. Consequently the fuser nip 50, as well as fuser member temperature (driven by the nipwidth 40) is adjusted to the correct value during the inter-frame between two sheets. Both controllers 220 and 230 change the respective nips 40 and 50 dynamically, in any well known manner, during the interframe between two sheets as discussed in more detail below.

Each nip control may include a cam and a stepper motor for a fixed displacement nip, a set of air regulated cylinders for constant load nip, a combination of both, or any combination of these and other electro-mechanical mechanisms well-known in the art. Since the temperature of the fusing roller (as driven by the heating rollers nip) and the nipwidth between the fusing and pressure members can be manipulated and adjusted for each sheet, such a fusing assembly system allows mixing of many different media weights and types seamlessly without any restriction on the run length of each media.

In distinct embodiments of the invention, the fusing member may be in the form of a roller, a belt or a sleeve, or variations thereof as are well-known in the art.

Figure 4:
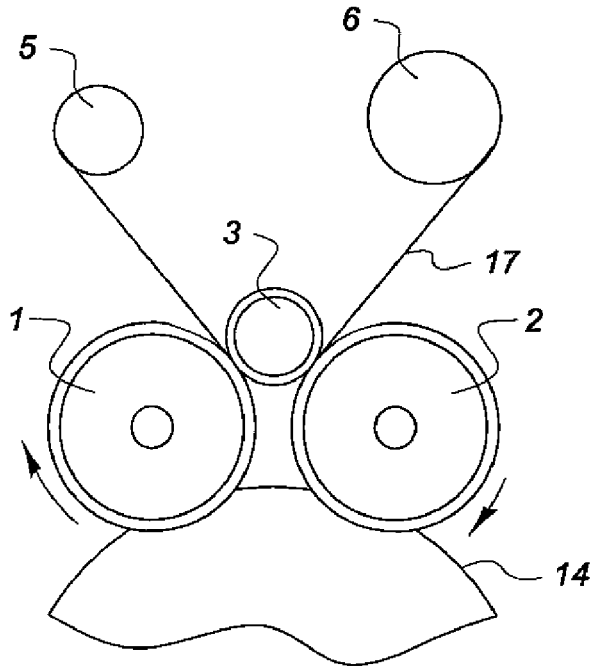
FIG. 4 shows a fuser roller with a single backup roller.

In a further embodiment of the invention (see FIG. 4), the cleaning web 17 may be placed in contact with the external heat transfer rollers $\mathbf{1}_H$, $\mathbf{2}_H$ using only a single back up roller 3.

The invention confers the advantage of enabling the printer to run jobs in document mode while mixing a variety of receivers, without loss of productivity or fusing quality. The invention also facilitates seamless printing on the widest possible ranges of media types and weights.

Figure 7:
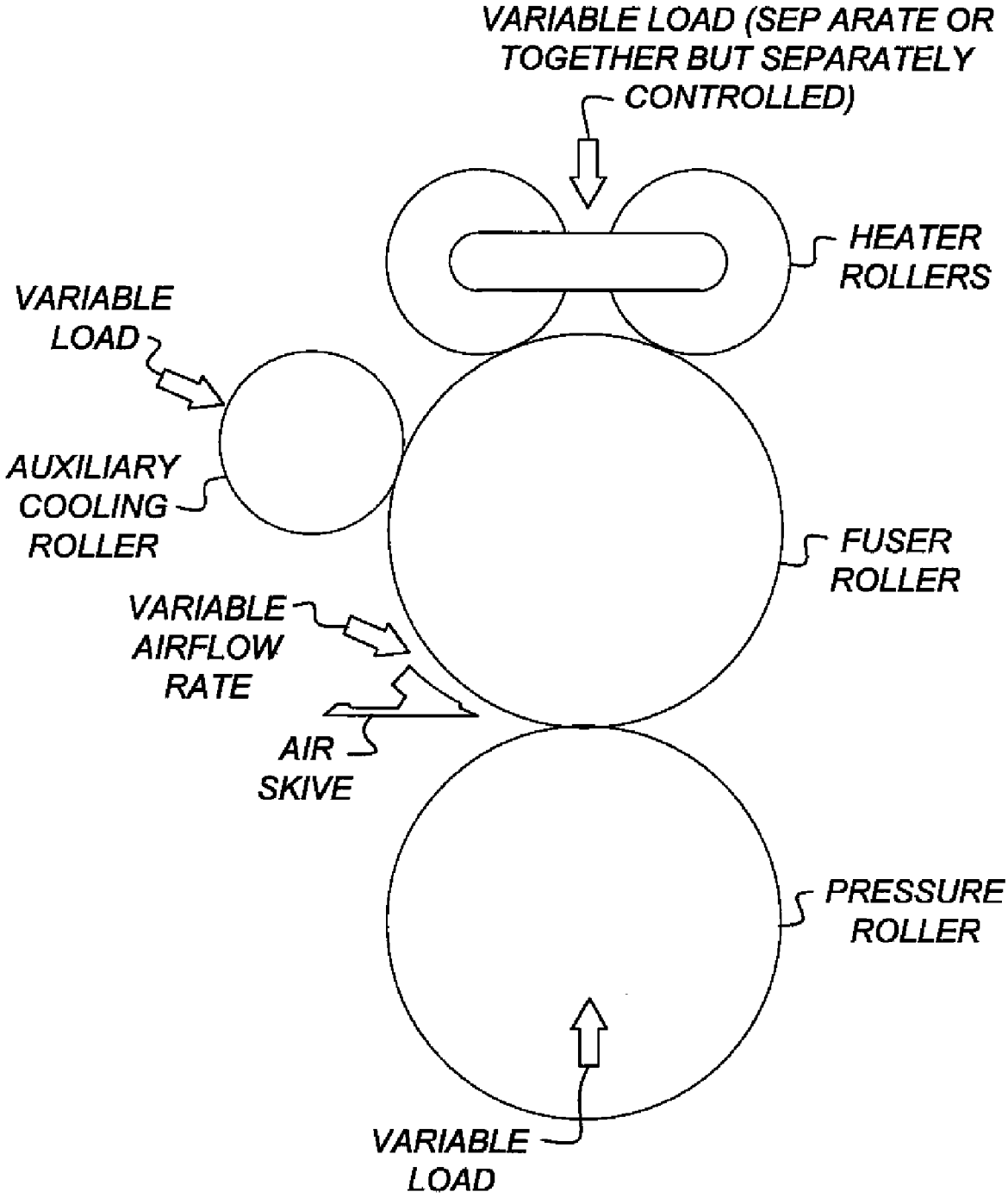
FIG. 7 shows another embodiment of the fuser roller system for the fuser assembly of FIG. 6.

FIG. 7 shows one embodiment of the invention with the cleaning web 17 placed in contact with both the external heat transfer rollers 1, 2 as well as a third cooling roller and an additional air skive that cools by blowing air into the nip. As substrates with images pass through the fusing nip, they draw heat from the fuser roller surface. The heat is replenished either through conduction from the heated fuser roller core or through application of external heater rollers. When cut sheets are fused, there is always a space between the separate sheets. This space is called the interframe. Thermally, the fuser roller sees the interframe as a space where there is less cooling of the fuser roller surface. As described below, at the exit from the fusing nip the temperature of the fusing member that contacted the interframe can range from 4 to 9° C. lower than the temperature of the adjoining fusing member surface, depending on the weight and coating of the substrates. The magnitude of the interframe temperature elevation drops over time, due to thermal contact with external heater rollers, the oil application subsystem, and the substrate on the next revolution of the fuser roller. Note that some thermal elevation can persist for at least three fuser roller revolutions.

The gloss of the fused image depends in part on the temperature of the fuser roller during the fusing process. When the fuser roller temperature is increased, the fused image will have higher gloss. The fuser roller thermal interframe artifact is harmful to the uniformity of gloss on the images. When large solid areas are printed the interframe artifact is visible as a cross-track stripe of slightly higher image gloss that has the same width as the interframe. Image quality would be improved if there were a way to keep the image gloss more uniform. The image gloss would be more uniform if the fuser roller surface temperature were more uniform. We can make the interframe artifact less objectionable by reducing the fuser roller temperature in the interframe.

For the purpose of reducing the image artifact, hereafter called the interframe artifact, four embodiments are described below. These embodiments are not the only embodiments of the herein described invention since, as one skilled in the art would understand, these embodiments could be used in various combinations or have additional features. The four embodiments for reducing the fuser roller surface temperature in the interframe region are described below in no particular order.

In the first embodiment the externally heated fuser has a variable engagement between the fuser roller and the external heater rollers. The amount of heat that the heater rollers provide to the fuser roller is determined by the degree of engagement (the nip loading) between the heater rollers and the fuser roller. The temperature of the fuser roller surface rises as it passes through the heater roller nips, and the fuser roller surface temperature raises less when the heater roller engagement is less. The present invention calls for the heater roller engagement to be briefly reduced, timed to make the engagement lower while the thermal interframe is passing through the heater roller nips. The engagement reduction causes the rise in the fuser roller surface temperature to be less in the thermal interframe than over the majority of the fuser roller surface. The duration and magnitude of the heater roller engagement reduction are adjusted to compensate for the elevated fuser roller surface temperature in the thermal interframe. The result is a smaller variation in the fuser roller surface temperature and therefore a smaller gloss change in the image.

In the second embodiment the fuser roller thermal interframe can be reduced with an auxiliary cooling roller that is mounted in contact with the fuser roller surface in a way that has variable engagement. The auxiliary cooling roller is designed to be a heat sink that would cool the fuser roller surface. The auxiliary roller is brought into contact with the fuser roller surface only in the thermal interframe region, with the timing and the engagement loading adjusted to remove the excess heat of the thermal interframe. Active cooling of the auxiliary roller may be necessary.

In the third embodiment the fuser, the pressure roller surface has a much lower temperature than does the fuser roller surface. The invention is to use the pressure roller as the auxiliary cooling roller that is mentioned in Idea 2. The engagement of the pressure roller would be altered during the interframe in such a manner as to increase cooling of the fuser roller surface in the interframe, where there is no substrate to remove heat.

In the fourth embodiment the fuser roller uses the skive to help release the substrates from the fuser roller surface at the fusing nip exit. One type of skiving system In the fuser the skiving system consists of air directed at the fuser roller surface in a manner that separates the substrate from the roller surface. The skive air is near room temperature and has the side effect of cooling the fuser roller surface. The air skive can cool the fuser roller surface by as much as 8° C.

The air skive cooling can be used to reduce the magnitude of the fuser roller temperature elevation in the interframe. The air skive can be turned on at a time when the interframe on the fuser roller surface is passing under the air jets of the skive, and turned off when the additional cooling is not needed. The air flow rate through the skive can be adjusted by means of a proportional valve to match the amount of cooling that is needed for a given substrate type.

There are two options for controlling the timing and magnitude of the air skive cooling.

The first method establishes the timing by predetermining situations and the appropriate actions, the relevant parameters to handle those situations and storing these in a look-up-table (LUT). These parameters would include timing of the roller rotation relative to when the thermal interframe is under the air skive. Substrate qualification empirically derived settings can also be used to determine in advance the amount of air flow that is needed for each type of substrate. The timing and amount of the air skive flow would them be programmed into the fuser controller. This would be a "blind" control method.

A second method uses one or more sensors that sense the fuser roller surface temperature. The thermal interframe could be sensed with a fast response thermal sensor and a high frequency data acquisition system. Feedback control would then be used to sense the thermal interframe and direct the appropriate response from the air skive.

Figure 8:
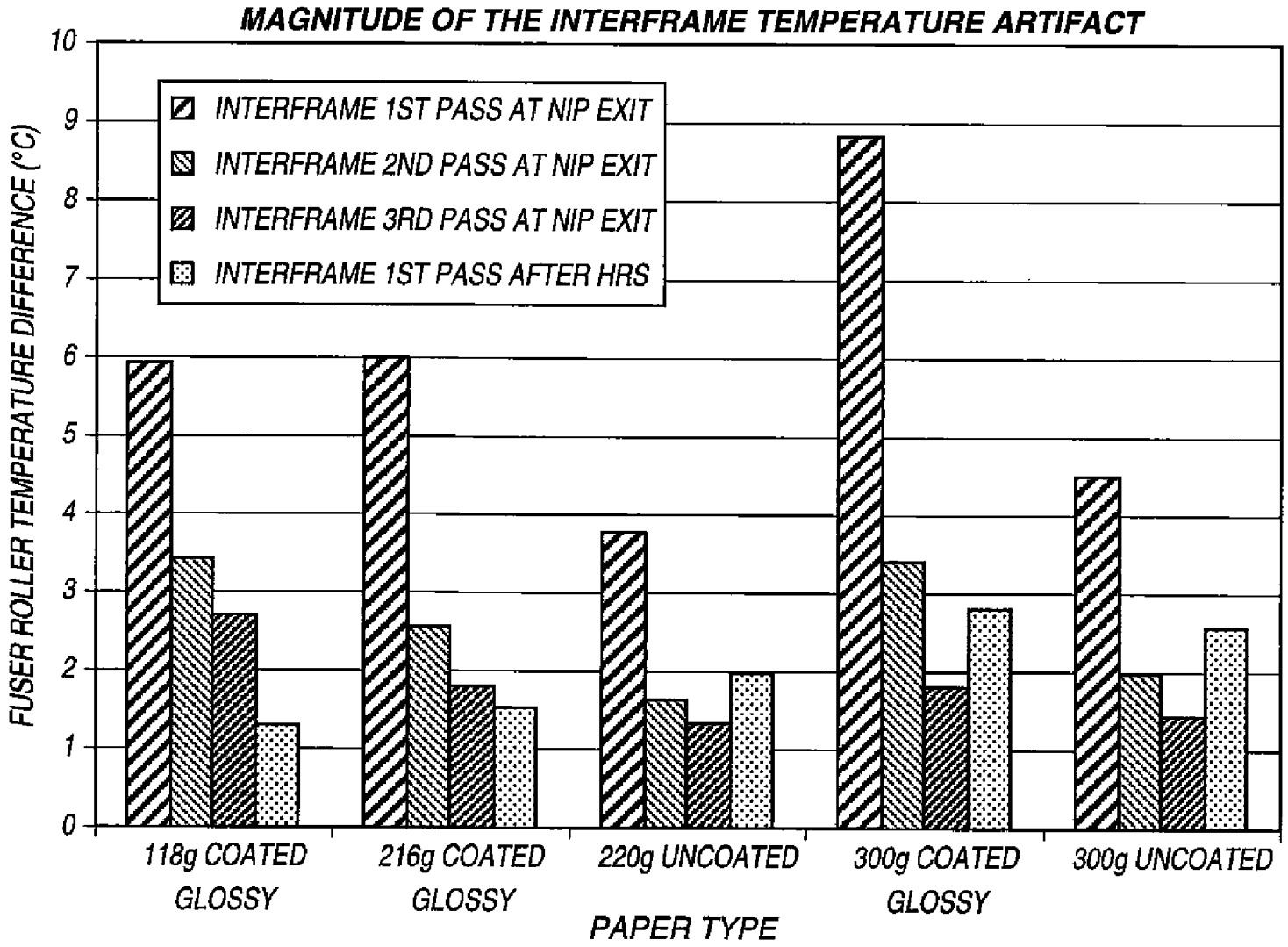
FIG. 8 shows a graph of the relationship between fuser roller temperature difference and paper type.
Figure 9:
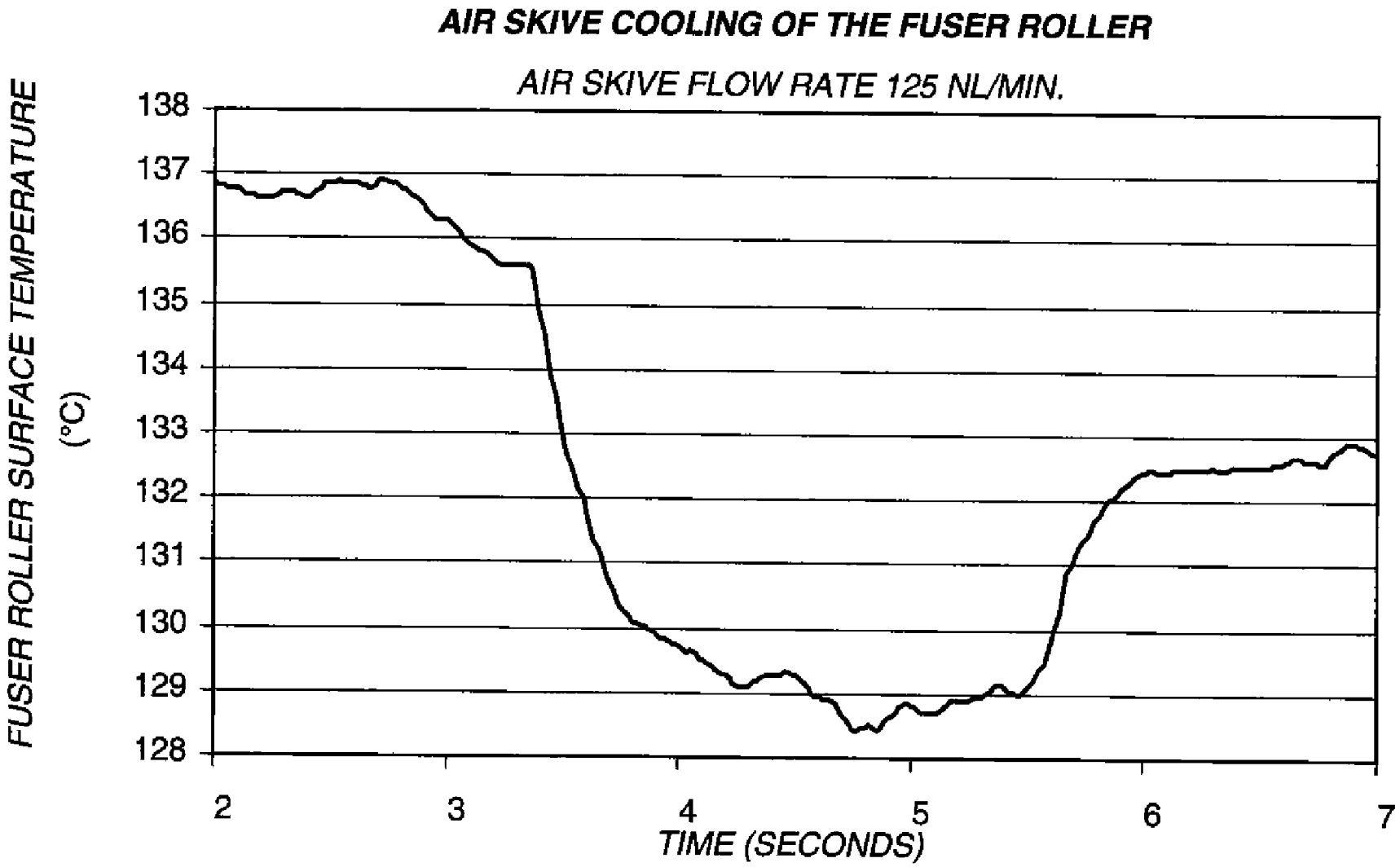
FIG. 9 shows a graph of the relationship between fuser roller surface temperature and time.

The data shown in FIG. 8 shows that the interframe artifact is most severe with the heavier papers. Sometimes air skives area not needed, such as with the heavier papers that may not need the air skive for successful release from the fuser roller surface. Therefore, use of the air skive for reduction of the interframe artifact does not necessarily interfere with the primary function of the air skive. Further FIG. 9 shows the time that the air skive can take to cool around 10 degrees.

Those skilled in the art understand that the functional elements of the sensor 201, 202 and the controllers 220, 230 may be implemented in different ways. In lieu of actual sensors, the machine may be pre-set for specific media types, weights and toner content. Likewise, the controllers 220, 230 may use electric stopper motors, hydraulics or pneumatic operators and other equivalent means to move the rollers and set the nips.

The invention has been described in detail with particular reference to certain preferred embodiment thereof, but it will be understood that variations and modifications can be effected within the spirit and scope of the invention.

The invention claimed is:

1. An electrostatographic printer with a roller fusing apparatus comprising:

a heated fusing member for fusing toner to sheets of receiver media;

one or more external heating members in heat transfer contact with said heated fusing member;

one or more external heat sink members in heat transfer contact with said heated fusing member;

a pressure member in contact with said heated fusing member to form a fusing nip there between;

a machine controller for changing fusing nip widths in accordance with the type of receiver media and the image on the media;

a heating member contact controller associated with said machine controller, for changing contact width between said external heating members and said heated fusing member;

a heat sink contact controller associated with said machine controller, for changing contact width between said external heat sink members and said heated fusing member;

and a pressure member nip controller associated with said machine controller, for changing nip width between said pressure member and said heated fusing member.

2. The apparatus of claim 1, wherein one or more external heating members are rollers, which contain one or more internal heating sources.

3. The apparatus of claim 2, wherein one or more internal heating sources are each independently controlled by said machine controller.

4. The apparatus of claim 1, wherein one or more external heating members and said external heat sink members are independent heat transfer rollers, each independently controlled by said machine controller.

5. The apparatus of claim 4, wherein said heated fusing member is controlled by said machine controller in conjunction with said heating member contact controllers and said heat sink contact controllers to adjust one or more of said heat transfer rollers in response to temperature of said heated fusing member.

6. The apparatus of claim 1, further comprising air knives to emit air streams at an air flow rate for stripping receiver media with fused toner from said heated fusing member and said pressure member wherein said airflow rate is controlled by said machine controller.

7. A method for fusing toner to sheets of receiver media in an electrostatographic printer, comprising for each arriving sheet of receiver media the steps of:

a. providing first data signals representative of characteristics of one or more of sheets of receiver media including a particular sheet of arriving receiver media;

b. providing second data signals representative of toner density for an image on said particular sheet of arriving receiver media;

c. providing third data signals representative of a fuser member comprising a fuser member temperature so that a selection can be made corresponding to one of said first, second or third data signals;

d. selectively heating said fuser member to bring said fuser member to a desired temperature for heat transfer of toner to a receiver media in accordance with at least one of said first, second or third data signals;

e. selectively adjusting pressure between a receiver media and said fuser member in accordance with one of said first, second or third data signals;

f. fusing the toner to the sheet of receiver media by said fuser member in contact with one or more external heat transfer rollers wherein a nip width between said external heat transfer rollers and said fuser member is adjusted to vary the amount of heat transfer between said external heat transfer rollers and said fuser member.

8. The method of claim 7, further comprising repeating steps a, b and c as required.

9. The method of claim 7 further comprising repeating steps a, b and c as required during an interframe interval, before the arrival of each sheet of receiver media.

10. The method of claim 7, wherein said fusing step further comprises fusing the toner to the sheet of receiver media by said fusing member in contact with one or more heat sink rollers wherein said nip width between said heat sink rollers and said fuser member is adjusted to vary heat transferred from said fuser member to said heat sink rollers.

11. The method of claim 7, wherein said third data signal representative of a member temperature includes at least one of a temperature of an interframe, said heated fuser member, an external roller, and a fuser roller.

12. The method of claim 7, wherein said third data signal representative of a member temperature includes at least one of a temperature of said external heater roller, a heat sink roller, an airflow rate and an external roller internal heat source, and said fuser member.

13. The method of claim 7, further comprising performing step c to determine said third data signal by sampling at least one of a lengthwise temperate and a circumferential temperature.

14. A method for fusing toner to sheets of receiver media in an electrostatographic printer, comprising for each arriving sheet of receiver media the steps of:

a. providing first data signals representative of characteristics of one or more of sheets of receiver media including a particular sheet of arriving receiver media;

b. providing second data signals representative of toner density for an image on said particular sheet of arriving receiver media;

c. providing third data signals representative of an interframe temperature so that a selection can be made of corresponding to at least one of said first or second data signals;

d. selectively heating a fusing member to bring said fusing member to a desired temperature for heat transfer of toner to a receiver media in accordance with at least one of said first or second data signals;

e. selectively adjusting pressure between a receiver media and said fusing member in accordance with at least one of said first or second data signals;

f. fusing the toner to the sheet of receiver media by said fusing member in contact with one or more extemal heat transfer rollers wherein a nip width between said external heat transfer rollers and said fusing member is adjusted to vary heat transferred between said external heat transfer rollers and said fusing member.

15. The method of claim 14, wherein said third data signal representative of a member temperature includes at least one of a temperature of said external heater roller, a heat sink roller, an airflow rate and an external roller internal heat source, and said fusing member.

16. The method of claim 14, further comprising performing step c to determine the third data signal by sampling at least one of a lengthwise temperate and a circumferential temperature.

17. The method of claim 14, wherein one or more external rollers are engaged to make temperature uniform based on a reading from said interframe area.

18. The method of claim 14, wherein an airflow is controlled to make the temperature uniform based on a reading from said interframe area.

19. The method of claim 14, wherein the fusing member temperature is adjusted to be uniformly homogeneous both in the lengthwise temperate and a circumferential temperature based on a reading from said interframe area.

* * * * *